US005247131A

United States Patent [19]

Okamoto et al.

[11] Patent Number: 5,247,131

[45] Date of Patent: Sep. 21, 1993

[54] ELECTRONIC MUSICAL INSTRUMENT WITH MULTI-MODEL PERFORMANCE MANIPULATOR

[75] Inventors: Tetsuo Okamoto; Eiichiro Aoki; Satoshi Usa, all of Hamamatsu, Japan

[73] Assignee: Yamaha Corporation, Hamamatsu, Japan

[21] Appl. No.: 628,324

[22] Filed: Dec. 14, 1990

[51] Int. Cl.[5] ..... G10H 1/12; G10H 1/18

[52] U.S. Cl. ..... 84/658; 84/661; 84/471 R; 84/483.1; 84/DIG. 9; 84/DIG. 10

[58] Field of Search ..... 84/609-620, 84/622-638, 649-669, 678-717, 471 R, 483.1, 600, DIG. 9, DIG. 10

[56] References Cited

U.S. PATENT DOCUMENTS

| | | | |
|---|---|---|---|
| 3,592,098 | 7/1971 | Zadig | 84/471 R |
| 4,794,838 | 1/1989 | Corrigau, III | 84/600 |
| 4,868,869 | 9/1989 | Kramer | 84/622 X |
| 4,958,551 | 9/1990 | Lui | 84/611 X |
| 4,984,276 | 1/1991 | Smith . | |

FOREIGN PATENT DOCUMENTS

| | | |
|---|---|---|
| 48-42963 | 12/1973 | Japan . |
| 6340199 | 10/1986 | Japan . |

*Primary Examiner*—Stanley J. Witkowski
*Attorney, Agent, or Firm*—Graham & James

[57] ABSTRACT

An electronic musical instrument capable of achieving a variety of performance mode. A manipulation region to be played with a hand manipulator is divided into regions of different performance modes. Tone signal parameters are generated differently depending on the selection of the performance region. Tone generator generates musical tone signals based on the tone signal parameters. The tone signal parameters are determined based on coordinate information on the manipulation region designated by the hand manipulator and pressure information applied on the coordinate position by the hand manipulator. The tone signal parameters comprise velocity information, pressure information and tone pitch information.

9 Claims, 16 Drawing Sheets

ELECTRONIC MUSICAL INSTRUMENT WITH MULTI-MODEL PERFORMANCE MANIPULATOR

BACKGROUND OF THE INVENTION a) Field of the Invention

This invention relates to an electronic musical instrument and more particularly to an electronic musical instrument adapted for generating parameters for controlling the musical sounds of a rubbed string instrument or a wind instrument.

b) Description of the Related Art

Most of the real time performance manipulators of the electronic musical instruments have been made of keyboards. A keyboard has a plurality of keys corresponding to the respective tone pitches. When a key in the keyboard is depressed, an associated key switch is closed (made) to generate a pitch signal corresponding to the tone pitch assigned to the depressed key.

In the case of a two-make switch, the first and the second key switches are closed (made) successively at a speed corresponding to the key depressing speed. Upon the make actions of the two switches, a tone pitch signal corresponding to the depressed key and a touch signal corresponding to the speed of the key depressing action derived from the make time difference between the first and the second key switch makings are generated. Those electronic musical instruments equipped with such keyboard are adapted to simulate the musical sounds of the keyboard instruments such as the piano and the organ.

Other electronic musical instruments include guitar synthesizer, wind controller, etc. The guitar synthesizer is adapted to simulate the musical sounds of the guitar. The wind controller is adapted to simulate the musical sounds of the wind instruments.

A rubbed string instrument such as violin changes the expression of the musical sound in a variety of ways, based on the speed of the string rubbing bow and the pressure of the string pressing bow.

When the musical sound of such a rubbed string instrument is to be simulated by an electronic musical instrument, roughly two ways can be thought of.

One is the method in which such basic performance manipulators of a rubbed string instrument as bow, string and fingerboard are directly used and, for example, the vibration of a string is transformed into an electric signal and treated electronically. The other is the method in which, without using bow, string and fingerboard, etc. of the natural rubbed string instrument, a performance manipulator or manipulators such as a keyboard, different from those of the natural rubbed string instrument, are used as the basic performance manipulators and a musical sound is simulated based on the performance of such manipulators.

When the bow, the string and the fingerboard similar to those of the natural musical instrument are used as the performance manipulators to cause actual vibrations of a string according to the former method, a rubbed string electronic musical instruments capable of achieving performance rich in expression can be realized. However, the performance using the performance manipulators similar to those of the natural rubbed string instrument requires techniques of a high grade, and long term exercise for its mastering. Therefore, those who are not well-trained in performance techniques cannot enjoy the performance of the rubbed string instrument.

According to the latter method, for example, the harmonies construction of the basic tone color of the violin are preliminarily studied to enable electronic synthesis of the basic musical sound. Then, the sounds of the violin, etc. are generated in response to the keyboard manipulation. Whereas the sound of the violin changes its musical expression in a variety of ways according to its bow speed, bow pressure, etc. while the bow is contacting the string, keyboard input has no function for giving such expressions. Thus, the performance is apt to become monotonic and poor in expression.

In the performance of the violin, there are employed such performances as arco (arcato) performance in which the bow rubs the string, and such specific performances as pizzicato performance in which the string is picked by a finger without using a bow. Those musical sounds generated by these performances have largely different natures.

Also in the performance of the guitar which is another kind of a string musical instrument, there are employed such specific performances as apoyando performance in which the finger which has picked a string is abutted to the next string, harmonics performance in which a string is picked while lightly touching a node for generating a harmonic sound to generate harmonic sounds, and legado performance in which performance is done by tapping the string only with the lefthand to generate a musical sound, etc. as well as the ordinary al aire performance in which the finger which has picked up a string is kept in space.

For generating such different musical sounds by the different performance modes in an electronic musical instrument, it is necessary to give different musical sound controlling information.

For example, in the arco performance of the violin, information necessary for generating a sustaining tone rich in expression includes the bow speed and the bow pressure. In the pizzicato performance, no sustaining sound is necessary and it is enough if an instantly decaying sound can be well controlled. Therefore, it will be possible to simulate the sounds of the pizzicato performance when there is given information expressing the rapid actions, even when there is almost no sustaining information.

In this way, the information required for controlling the musical sound also changes depending on the performance. Japanese Patent Laid-Open Sho. 63-40199 discloses a wind instrument which generates the musical sound in correspondence to the breath pressure, and the embouchure (Ansatz, representing the form of the lips, the lower facial muscles and the structure of jaws and teeth). In such wind instrument, the information required for controlling the musical sound differs depending on the performance such as ordinary (long tone) performance, tonguing performance, etc.

As is described above, according to the conventional technique, the kinds of the controlling information which the keyboard type electronic musical instrument can generate are few, and are not sufficient for the performance of the rubbed string instruments, etc. The guitar synthesizer and the wind controller are adapted for the performances of the guitar and the wind instrument, but have limitations for achieving performance of other kinds of instruments.

SUMMARY OF THE INVENTION

An object of this invention is to provide an electronic musical instrument capable of enhancing the generation of musical sounds rich in expression of the rubbed string instrument and the wind instrument.

Another object of this invention is to provide an electronic musical instrument adapted to simulate the musical sound of the rubbed string instrument.

According to an aspect of this invention, there is provided an electronic musical instrument comprising, means for receiving manipulation, having a manipulation region of at least one dimension, means for detecting position of manipulation in said manipulation region when performance manipulation is done in the manipulation region, means for discriminating a first performance mode and a second performance mode based on said opposition of manipulation, means for generating different tone controlling signal based on a performance manipulation, depending on the discrimination of first performance mode or second performance mode, and means for generating a tone signal based on said tone controlling signal.

Further, there is provided an electronic musical instrument having means for detecting the velocity information of the manipulation from the time change of the manipulation position of the performance manipulation, for the sustaining performance such as arco performance of the rubbed string instrument and the long tone performance of the wind instrument.

Further, there is provided an electronic musical instrument having means for detecting the pressure of the performance manipulation in a manipulation region, in the performance of the rubbed string instrument.

Also there is provided an electronic musical instrument having a function of transmitting pressure information of the performance manipulation to the means for receiving manipulation.

Here, performance manipulation includes manipulation for selecting the performance mode, as well as the performance directly generating the musical sound.

In the rubbed string instrument and the wind instrument, various performances are done. To respond to these performances, means for receiving manipulation having a manipulation region (i.e., zone) of one or more dimensions is utilized. A plurality of selection regions (i.e., zones) are set in the manipulation region. Performance of a desired mode can be done by selectively manipulating a selection region.

In the case of the arco performance of the rubbed string instrument or the long tone performance of the wind instrument, the manipulation position of the performance manipulation is varied in the manipulation means depending on the time, to provide information corresponding to the bow speed or information corresponding to the embouchure. The variety of information can be provided from the time change of the manipulation position.

Further, in the performance of the rubbed string instrument or the wind instrument, the pressure applied to a string or the breath pressure changes the musical sound. Means for detecting the pressure of the performance manipulation in the manipulation means can provide information on the bow pressure or the breath pressure.

Performance is made easy by utilizing a manipulator for achieving performance manipulation in the manipulation region of the means for receiving manipulation.

Convenient system is realized by affording the function of transmitting the pressure of performance manipulation from the manipulator to the means for receiving manipulation.

BRIEF DESCRIPTION OF THE DRAWINGS

FIGS. 3A and 3B illustrate the characteristics of the non-linear circuit, wherein FIG. 3A is a graph for illustrating the functions of the division circuit 44 and the multiplication circuit 46 for altering characteristics of the non-linear circuit 45, and FIG. 3B is a graph showing the hysteresis characteristic given by a feedback loop.

DESCRIPTION OF THE PREFERRED EMBODIMENTS

Figure 1:
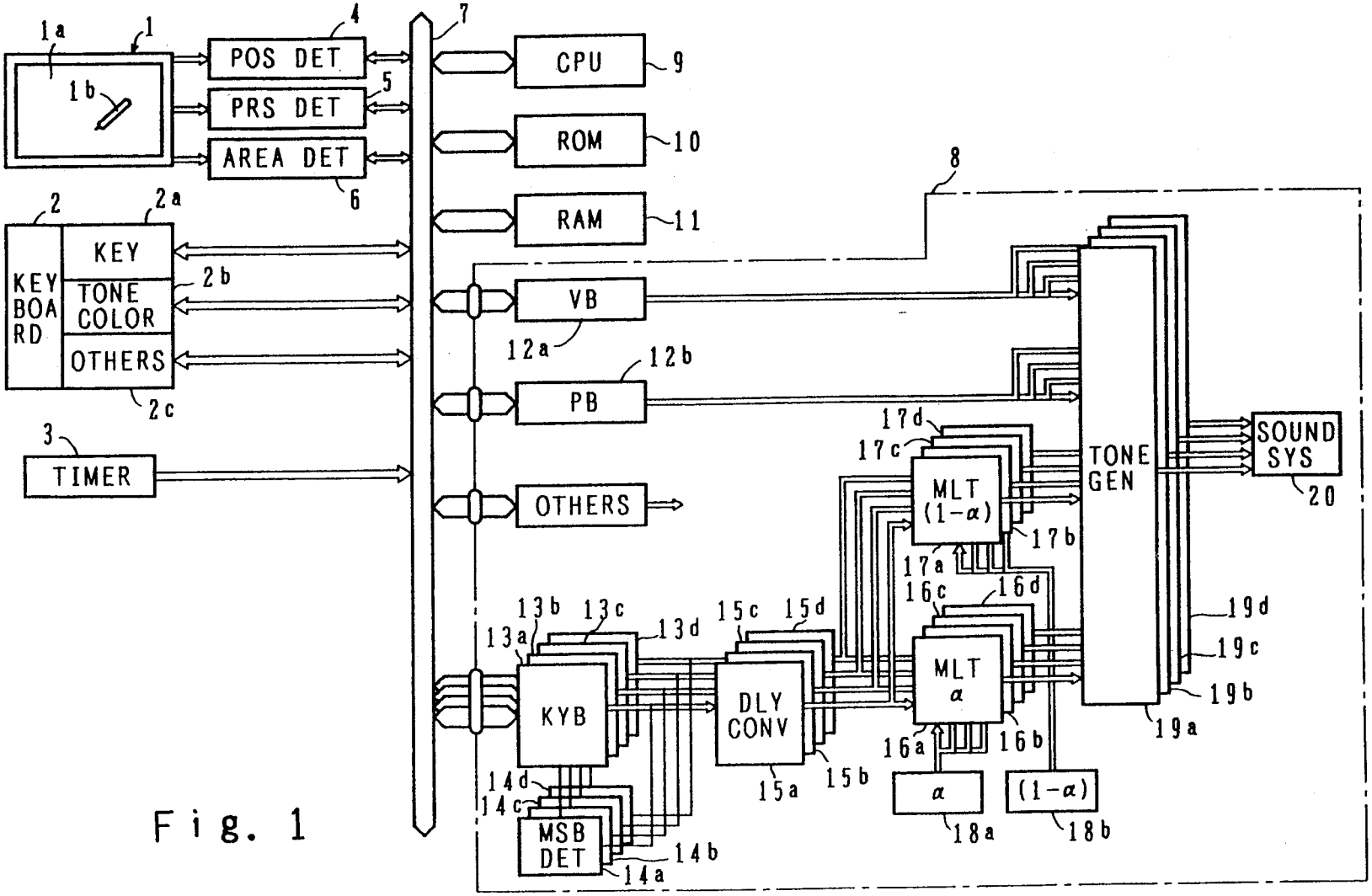
FIG. 1 is a block diagram of a hardware structure of an electronic musical instrument.

FIG. 1 shows a hardware construction of an electronic musical instrument according to an embodiment of this invention adapted for generating musical sounds of a rubbed string instrument. In a plane manipulator 1, a movable manipulator **1*b* of a pen shape is manipulated on a manipulation region of a flat plane shape (tablet, or means for receiving manipulation by a manipulator) 1*a*. The coordinate information in the manipulation plane of the contact portion of the pen shaped movable manipulator 1*b*, the pressure information of the force by which the movable manipulator 1*b* is depressed on the manipulation region 1*a*, and the mode selection information representing that a specific area in the manipulation region 1*a* is manipulated are supplied to a bus 7 through a coordinate detector 4, a pressure detector 5, and an area detector 6. A keyboard 2 includes a multiplicity of keys 2*a* for designating a tone pitch, tone color pads 2b for designating a tone color by the name of the instrument, etc. and other manipulators 2c for designating other functions, and supplies the respective information to the bus 7. A timer 3 supplies the timing information for issuing the timer interrupt to the bus 7**.

Further, a CPU 9 for performing predetermined processing treatment, a ROM 10 for storing the program to be executed in the CPU, etc., a RAM 11 including various kinds of registers and work memories etc. for storing various kinds of temporary information to be used for executing the program, and a tone signal generating circuit 8 are connected to the bus 7.

Here, the ROM 10 stores a program for generating the musical sound, and the CPU 9 performs the musical sound synthesizing processing utilizing the registers in the RAM 11, etc.

The tone signal generating circuit 8 includes a velocity buffer 12a for receiving the velocity information from the bus 7, and a pressure buffer PB 12b for receiving the pressure information from the bus 7, which supply the velocity information and the pressure information to the tone generators 19a, 19b, 19c, 19d. Although a structure is shown in which a plurality of tone generators are provided, one tone generator can do similar functions when time sharing control is employed.

The tone pitch information given by manipulating a key 2a in the keyboard 2 is stored in key buffers KYB 13a, 13b, 13c and 13d. Here, four key buffers are provided in correspondence to the four strings of a rubbed string instrument such as violin and viola. The key data stored in the key buffers KYB 13a to 13d includes the most significant bit MSB representing the on/off of the key and remaining bits of the pitch data representing the pitch. The MSB detecting circuits 14a to 14d detect the MSB of the key data. If MSB="1" (key on), the key data is stored in the key buffer 13a to 13d. Here, the MSB may be removed from the stored data (may not be stored). The pitch data are sent to the corresponding delay varying circuits 15a to 15d and supplied to the tone generators 19a to 19d through multiplication circuits 16a to 16d and 17a to 17d. The delay varying circuits 15a to 15d decrease the number of stages of delay when pitch is high and increase the number delay stages when the pitch is low so that the number of circulation in a predetermined time (frequency) is changed. In the multiplication circuits 16a to 16d, a predetermined coefficient $\alpha$ is multiplied to the inputted pitch. In the multiplication circuits 17a to 17d, another predetermined coefficient $(1-\alpha)$ is multiplied to the inputted pitch. These two multiplications represent that a string of a rubbed string instrument from the bridge to the depressed finger position on the fingerboard may be divided into two portions at the position where the bow rubs the string. Namely, that the addition of the two coefficients makes 1 represents the basic length from the depressed finger position to the bridge which determines the pitch. When one coefficient $\alpha$ corresponds to the distance from the string rubbing position to the bridge, the other coefficient $(1-\alpha)$ will correspond to the distance from the string rubbing position to the depressed finger position. In this way, the information representing the pitch is supplied to the tone generators 19a to 19d. The velocity buffer 12a and the pressure buffer 12b are registers temporarily storing the velocity information and the pressure information derived from the moving velocity and the depressing pressure of the movable manipulator 1b of the plane manipulator 1 on the manipulation region 1a, in correspondence to the bow speed and the bow pressure.

Tone signals are generated in the tone generators 19a to 19d based on the velocity information and the pressure information together with the pitch information, and supplied to a sound system 20 to generate the musical sound. Here, each of the tone generators 19a to 19d includes a formant filter for simulating the behavior of the belly of the rubbed string instrument. The sound system 20 includes means for transforming the digital musical sound signal to an analog signal, means for amplifying the analog signal and means for transforming the electric signal into an acoustic signal.

In this way, musical sounds of a rubbed string instrument which can be varied its expression in a variety of ways in correspondence to the bow speed and the bow pressure can be generated.

Now, among the registers provided in the RAM, major ones will be explained hereinbelow.

Event buffer register (EVTBUF)

This is a register for storing key event data corresponding to key depression and key release of a key 2a in the keyboard, and includes an on/off data and key data representing the tone pitch. In the case of a rubbed string instrument, four event buffer registers are provided to enable storing of four key events, considering the case where four strings are performed simultaneously These buffers play the role of storing the tone pitch data temporarily.

X position register (X)

This is a register for storing the X directional position xp of the current or present manipulation position of the pen manipulator 1b, which is the movable manipulator, in the tablet 1a which forms a plane for receiving manipulation.

X position register (xn)

This is a register for storing the X directional position xn of the pen manipulator 1b at the time of previous timer interrupt.

Here, the transition distance in the X direction can be calculated from the values of the X directional positions xp and xn at the current and the previous timer interrupts.

Y position register (Y)

This is a register for storing the Y directional posiiton yp of the current manipulated position of the pen manipulator 1b in the tablet 1a.

Y position register (yn)

This is a register for storing the Y directional position yn of the pen manipulator 1b at the time of previous timer interrupt.

The transition distance in the Y direction can be calculated from the two values of the Y directional position Yp of the current timer interrupt and the Y directional position yn at the previous timer interrupt.

Velocity register (V)

This is a register for storing the velocity representing the bow speed. This register stores the velocity information derived from the transition distance based on the X directional transition distance and the Y directional transition distance as described above (and by dividing it by time).

Pressure register (P)

This is a register in the RAM for storing the pressure data derived from the output Pθ of the pressure sensor provided in the plane manipulator 1.

In the tone signal generating circuit 8, there are also provide a velocity buffer VB and a pressure buffer PB.

Flag OLD Register

This is a register for storing 1 or 0 representing that the flag OLD is set or reset. If this flag is 1, it means that the phenomenon represented by this flag has already been detected and this is the timer interrupt of the second and on time.

Timer register (T)

This is a register for storing the time during which the movable manipulator such as pen has been contacting the tablet.

Also, there are provided in the RAM other registers for storing various constants and variables, but the description thereof are omitted here.

Figure 2:
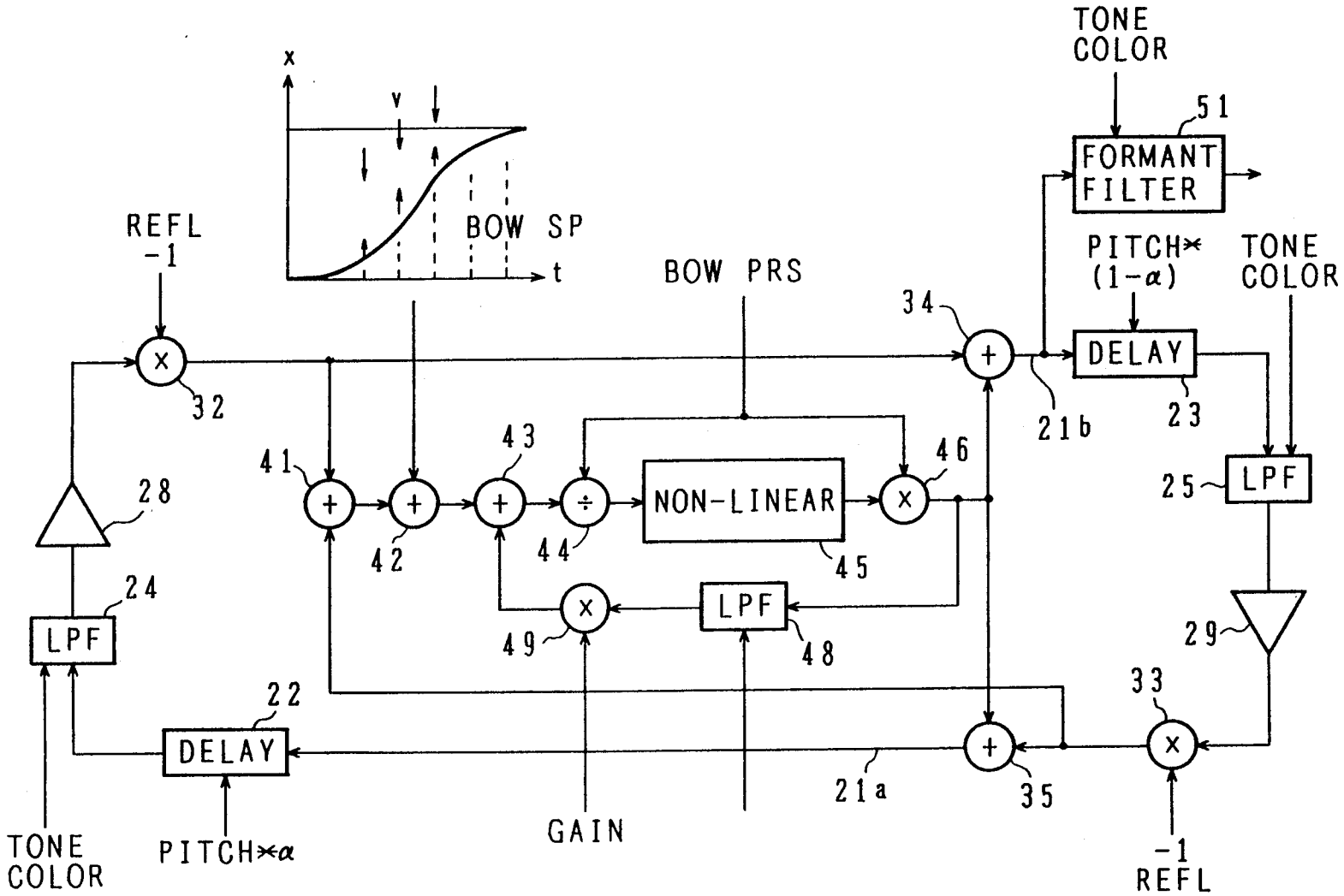
FIG. 2 is a circuit diagram of a main part of a tone signal generating circuit 8 used in the electronic musical instrument of FIG. 1.

FIG. 2 is an equivalent circuit diagram showing a main part of a tone signal generating circuit 8 which constitutes a sound source model of a rubbed string instrument.

Corresponding to the rubbing action of a bow on a string of a rubbed string instrument, a bow speed signal is generated and inputted to an addition circuit 42. This bow speed signal is an initializing signal and supplied to a non-linear circuit 45 through an addition circuit 43 and a division circuit 44. The non-linear circuit 45 is a circuit for representing the non-linear characteristic of a string of the violin.

Figure 3A:
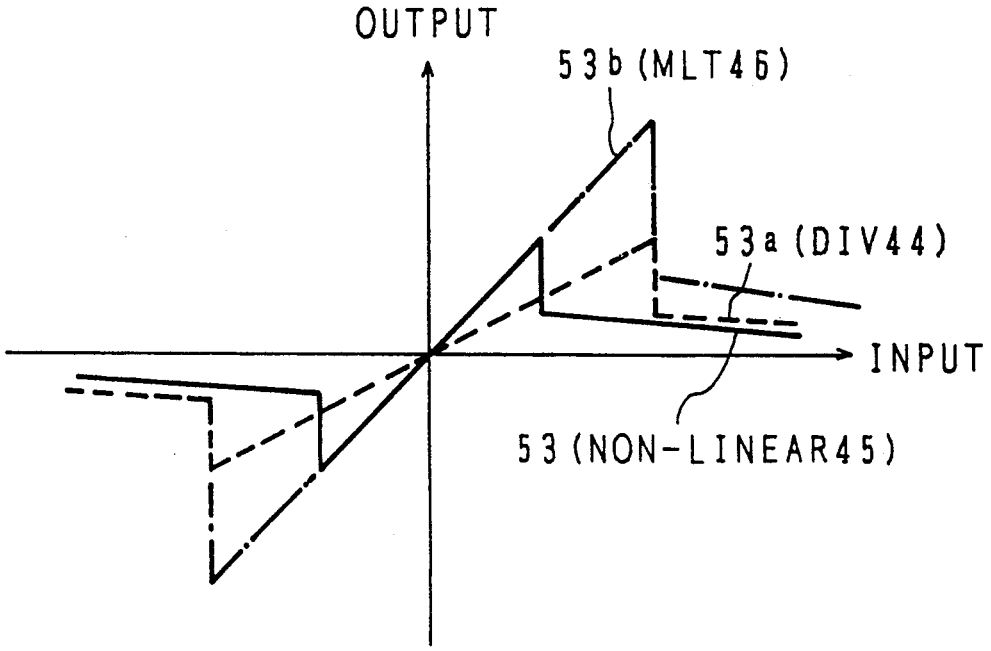

As is shown in FIG. 3A, the characteristic 53 of the non-linear circuit 45 includes a substantially linear region from the origin to certain points and the outer regions of changed characteristic. when the string of a rubbed string instrument such as violin is rubbed by the bow, as long as the bow speed is slow, displacement of the bow is almost equivalent to the displacement of the bow, and the movement of the bow can be represented by the term of the static friction coefficient. This phenomenon is represented by the substantially linear characteristic region centering around the origin. When the relative speed of the bow with respect to the string exceeds a certain value, the velocity of the bow and the displacement velocity of the string are no longer the same. Namely, the dynamic friction coefficient determines the movement, in place of the static friction coefficient. This change from the static friction coefficient to the dynamic friction coefficient is represented by the step portion.

In FIG. 2, the output of the non-linear circuit 45 is supplied to two addition circuits 34 and 35 through a multiplication circuit 46.

The division circuit 44 on the input side and the multiplication circuit 46 on the output side of the non-linear circuit 45 receive the bow pressure signal and modify the characteristic of the non-linear circuit 45. The division circuit 44 on the input side changes the input signal to a smaller value by dividing the same. Namely, as shown by a broken line 53*a* of FIG. 3A, when there is connected the division circuit 44, even when a large input is applied, an output as if the input was small is generated. The multiplication circuit 46 on the output side plays the role of increasing the output of the non-linear circuit 45. Namely, the multiplication circuit 46 increases the characteristic 53*a* produced by the division circuit 44 and the non-linear circuit 45 to a larger value of the output to produce a characteristic 53*b*. Here, upon the same bow pressure signal, first dividing the input and then multiplying the output represents dividing a characteristic by a coefficient C0 in the division circuit 44 and multiplying the result with the same coefficient C0 in the multiplication circuit 46. In this case, the total characteristic 53*b* of a dotted broken line lies on the extension of the characteristic 53 which is produced solely by the non-linear circuit 45, and has a shape which is multiplied by C0 both in the abscissa direction and in the ordinate direction. It is also possible to differentiate the coefficient of the multiplication circuit from the coefficient of the division circuit, to form a different shape.

Addition circuits 34 and 35 are provided in the circulating signal paths 21*a* and 21*b*. This circulating signal path 21 constitutes a closed loop for circulating the tone signal, corresponding to the string of the rubbed string instrument. This circulating signal path includes two delay circuits 22 and 23, two low pass filters (LPF) 24 and 25, two decay circuits 28 and 29, and two multiplication circuits 32 and 33. Each of the delay circuits 22 and 23 receives the product of the pitch signal representing the tone pitch and the coefficient $\alpha$ or $(1-\alpha)$ and gives a predetermined delay time. The total delay time required for a signal to circulate the circulating signal paths 21*a* and 21*b* and return to the original position determines the basic pitch of the tone signal. Namely, the sum of the delay times of the two delay circuits 22 and 23, pitch x $\{\alpha+(1-\alpha)\}$=pitch, mainly determines the basic pitch. One delay circuit corresponds to the distance from the position where the bow touches the string to the bridge, and the other corresponds to the distance from the position where the bow touches the string to the position where a finger depresses the string.

Although the pitch is mainly determined by the delay circuits 22 and 23, other factors included in the circulating signal path such as LPF 24 and 25, decay controls 28 and 29 also produce delays. Strictly, the exact factors for determining the pitch of the tone signal to be generated is the sum of the total delay times included in the loop.

The LPFs 24 and 25 simulate the vibration characteristics of various strings, by modifying the transmission characteristics of the circulating waveform signal. A tone color signal is generated by selecting a tone color pad 2*b* on the keyboard, and supplied to the LPFs 24 and 25 to change over the characteristic to simulate the musical sound of a desired rubbed string instrument. When the vibration is transmitting on the string, the vibration gradually decays. The decay controls 28 and 29 simulate these decays of the vibration transmitting on the string.

The multiplication circuits 32 and 33 multiply the reflection coefficient $-1$ in correspondence to the reflection of the vibration at a fixed end of the string. Namely, assuming the reflection at the fixed end without decay, the amplitude of the string is changed to the opposite phase. The coefficient $-1$ represents this opposite phase reflection. Decays in the amplitude at the reflection is incorporated in the decays in the decay controls 28 and 29.

In this way, the motion of the string of the rubbed string instrument is simulated by the vibration circulating on the circulating signal paths 21*a* and 21*b* which correspond to the string.

Further, the motion of the string of a rubbed string instrument has hysteresis characteristic. For simulating the hysteresis, the output of the multiplication circuit 46 is fed back to the input of the non-linear circuit 45 through the LPF 48 and the multiplication circuit 49. The LPF 48 serves to prevent oscillation of the feedback loop.

Letting the input from the addition circuit 42 to the addition circuit 43 be u, the input from the feedback path to the addition circuit 43 be v, and the amplification factor of the division circuit 44, the non-linear circuit 45 and the multiplication circuit 46 in total be A, the output w of the multiplication circuit 46 can be represented by $(u+v)A=w$. Letting the gain of the negative feedback loop including the LPF 48 and the multiplication circuit 49 be B, the amount of feedback v is represented by $v=wB$. Arranging these two equation, $$(u + wB)A = w, \qquad w = uA/(1 - AB).$$

In the case of no feedback, i.e. $B=0$, the output w can be simply represented as $w=uA$, representing that the input u is simply multiplied by a factor A and is outputted. When there is negative feedback of a gain B, for obtaining an output of the same magnitude, an input $(1-AB)$ times (B is negative) as large as the case of $B=0$ should be applied.

Figure 3B:
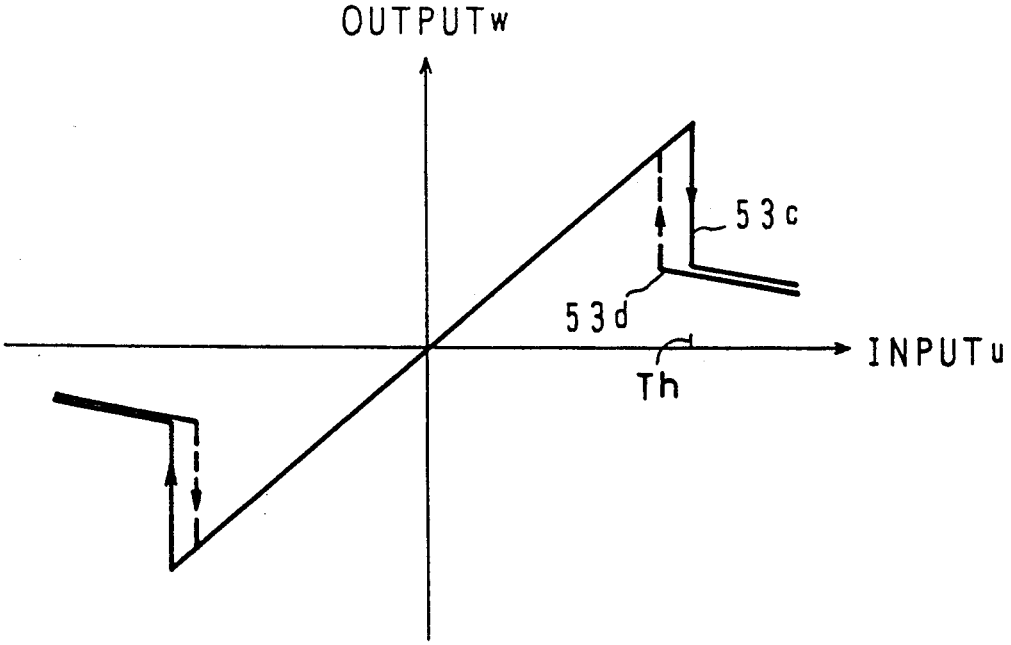

The characteristic when the input is increasing and there is such feedback is represented by curve 53*c* in FIG. 3B. When the input increases to a certain value, there occurs transition from the static friction coefficient to the dynamic friction coefficient and the output decreases stepwise. This threshold value is shown by Th.

In case when the input has once exceeded the threshold value Th and then decreases to a smaller value again, the output w is small and hence the feedback amount $v=Bw$ is also small. Namely, even if the magnitude of the signal inputting to the non-linear circuit 45 is the same, the negative feedback amount is small in the case of the dynamic friction coefficient region compared to the static friction coefficient region and hence the input u from the addition circuit 42 to the addition circuit 43 becomes smaller.

Let us consider the magnitude of the input u from the addition circuit 42 when the input to the non-linear circuit 45 becomes the threshold value. When the input is increasing, the static friction coefficient dominates the motion, a strong negative feedback is applied corresponding to a large output, and hence the transition occurs at a larger input Th. When the input is decreasing, the dynamic friction coefficient dominates the motion, the negative feedback is small corresponding to a small output, and hence the transition occurs at a smaller input value u. Therefore, the relation between input u and the output w when the input is gradually increasing and when the input is gradually decreasing can be represented as in FIG. 3B, where the characteristic curve 53*c* and another characteristic 53*d* represent the increasing and the decreasing characteristics which jointly form a hysteresis characteristic. The magnitude of hysteresis is controlled by the gain of the multiplication circuit 49.

In this way, according to the tone signal generating circuit shown in FIG. 2, the motion of the string of a rubbed string instrument can be simulated and a basic waveform of the tone signal can be produced.

An output is derived from some point in the circulating signal paths 21*a* and 21*b* as shown in FIG. 2 and is supplied to the sound system through a formant filter 51 which simulates the characteristic of the belly of a rubbed string instrument.

It can also be arranged that formant filter 51 varies the characteristics upon reception of a tone color signal.

In the tone signal generating circuit shown in FIG. 2, the signal having the motive power for generating the tone signal is given by the bow speed. Also, bow pressure is used as the signal for controlling the characteristic of the non-linear circuit 45. Namely, the bow speed and the bow pressure are necessary as the basic parameters for simulating the musical sounds of a rubbed string instrument. It is preferable that these parameters are controllable based on the player's will or the performance manipulation of a player. The parameter for designating the tone pitch can be derived by manipulating a key 2*a* in the keyboard 2, but information on the bow speed and the bow pressure cannot be obtained from the keyboard. Therefore, the system of FIG. 1 employs the plane manipulator 1. The plane manipulator 1 includes, for example, a tablet 1*a* and a pen manipulator 1*b*.

FIGS. 4A to 4F show structural examples of the tablet of the plane manipulator.

Figure 4A:
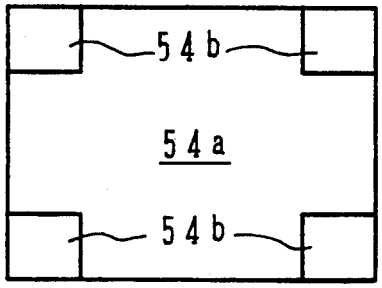
FIGS. 4A to 4F are schematic diagrams for illustrating various configurations of the tablet of the performance manipulator.

In FIG. 4A, regions (i.e., zones) 54*b* for designating a special performance or performances are set at the four corner portions of a plane and the central portion (i.e., zone) 54*a* designates the ordinary performance. For example, in the performance of the violin, the central portion 54*a* designates the arco performance and the rectangular portions 54*b* at the four corners designate the pizzicato performance. By touching either of these regions with a pen manipulator, etc., the arco performance or the pizzicato performance is designated. In the arco performance region 54*a*, when the pen manipulator is slided thereover, the velocity is detected to generate the bow speed signal. In the pizzicato performance region 54*b*, since the bow speed is no longer necessary, it may be arranged that no bow speed signal is generated even when the pen manipulator is moved. For example, when the special performance regions 54*b* at the four corners are $0<X<x1$ and $0<Y<y1$, $0<X<x1$ and $yn-1<Y<yn$, $xn-1<X<xn$ and $yn-1<Y<yn$, and $xn-1<X<xn$ and $0<Y<y1$, discrimination is done whether either of these four simultaneous conditions holds. When it holds, discrimination is done that the performance is the special performance.

Figure 4D:
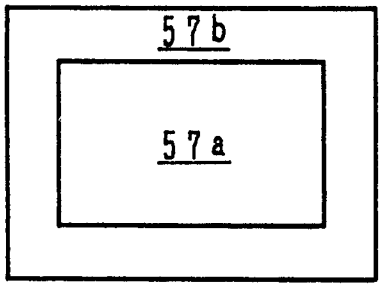
Figure 4B:
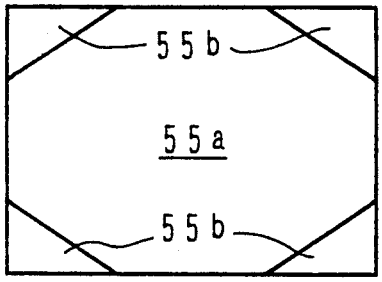

In FIG. 4B, the regions (i.e., zones) of the special performance are defined by triangle regions, being different from rectangle regions of FIG. 4A. The central region (i.e., zone) 55*a* designates the ordinary performance such as arco performance and the triangle regions 55*b* at the corners designate the special performance such as pizzicato performance.

Although an example is presented wherein the arco performance and the pizzicato performance are employed as the ordinary performance and the special performance, the combination is not limited thereto.

Figure 4E:
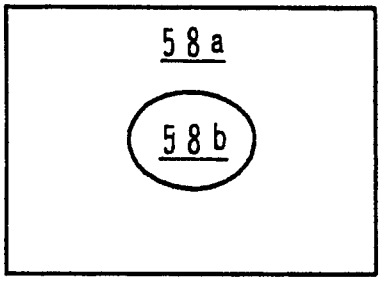
Figure 4C:
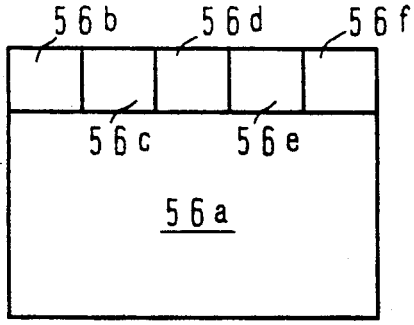

FIG. 4C shows performance regions (i.e., zones) of the function key type.

Performance designating regions (i.e., zones) 56b, 56c, 56d, 56e and 56f of the function key type shown in the upper portion of the figure designate predetermined special performances, respectively. The wide region (i.e., zone) 56a in the lower part designates the ordinary performance.

In this case, it can also be arranged that the performance mode is selected by the function keys in the upper portion and the performance is done in the performance region 56a in the lower portion.

In FIG. 4D, the manipulation plane is divided into a central region (i.e., zone) and a peripheral region. The central region 57a designates ordinary performance and the peripheral region (i.e., zone) 57b designate the special performance.

In FIG. 4E, a small special performance region (i.e., zone) 58b is provided in a central portion and a wide peripheral region 58a is used for the ordinary performance region. For example, a pen manipulator is continuously manipulated in the peripheral region 58a to achieve arco performance, while touching the central special performance region 58b to do the pizzicato performance according to necessity.

Although description has been mainly made on the case of the violin, it is also possible to play other instruments such as guitar as another string instrument, and wind instruments.

Figure 4F:
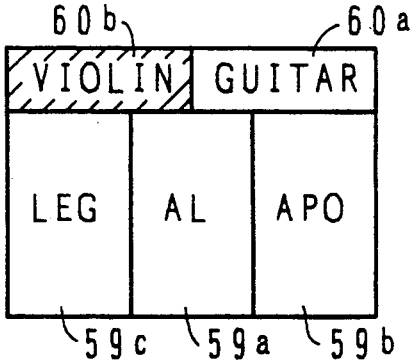

FIG. 4F shows a plane manipulator of the type in which the kind of instrument is selected by function key type regions (i.e., zones) and various performance modes are assigned to plurality of performance regions (i.e., zones) in the lower part. Instrument selecting regions 60a and 60b of the function key type designate, for example, violin and guitar.

When the guitar region 60a is selected, for example, an a1 aire region (i.e., zone) 59a as the ordinary performance, an apoyando region (i.e., zone) 59b and a legato region 59c as the special performances are designated in the lower wide performance regions (i.e., zones). In this way, the plane is divided and a designated performance is done in one of the divided regions (i.e., zones).

For obtaining the bow speed information of the violin, etc., a movable manipulator such as pen manipulator may be moved in a specified performance region and the movement speed may be detected and used as a kind of bow speed. For achieving this, it is necessary to detect the position in the tablet where the movable manipulator makes contact, similar to the previous embodiment.

Figure 5A:
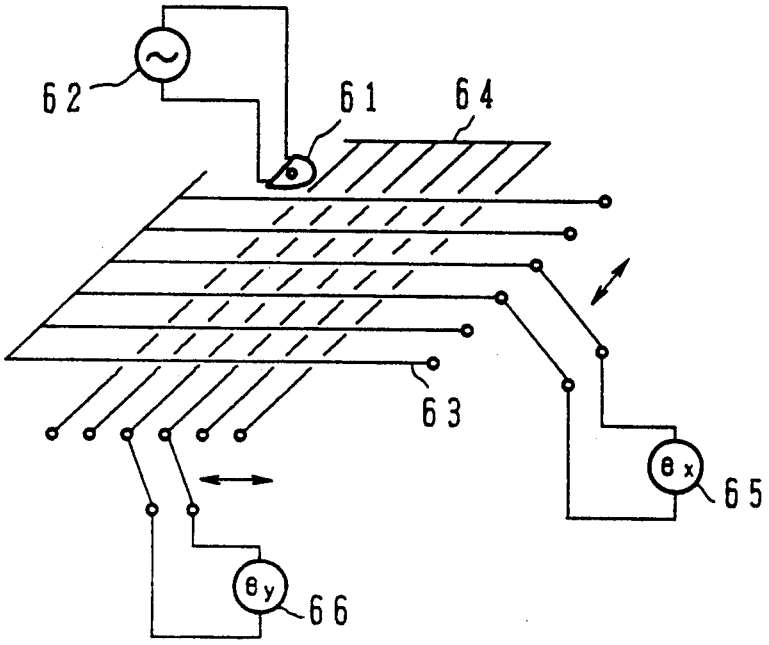
FIGS. 5A to 5E are schematic diagrams for illustrating structural examples of the performance manipulator.
Figure 5B:
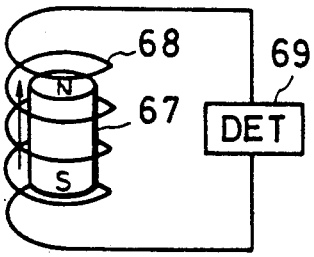
Figure 5C:
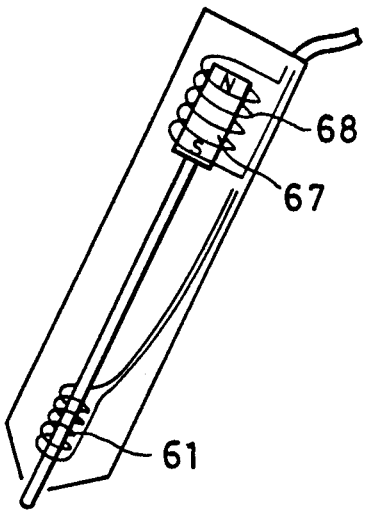

FIGS. 5A to 5C show an example of the structure of the plane manipulator.

FIG. 5A shows a position detecting plane manipulator of the electromagnetic induction type. A movable manipulator has ac power source 62 and a coil 61 and generates an ac magnetic field.

By approaching the coil 61 to the tablet, an ac magnetic field is established in the tablet plane. In the tablet, there are disposed a plurality of X direction detection lines 63 which are aligned along X direction and has each one end connected in common, and a plurality of Y direction detection lines 64 which are alined along Y direction and has each one end connected in common. At the open end of these detection lines, detectors 65 and 66 are connected to the adjacent detection lines of X direction and adjacent detection lines of Y direction respectively and are successibly scanned. Namely, since an ac magnetic field is generated in the neighborhood of the coil 61 of the movable manipulator, an induction current is induced in the detection lines therebelows. By detecting this induction current in the detectors 65 and 66, the position of the coil of the movable manipulator is detected. The movable manipulator may be constituted, for example, by a pen manipulator containing the coil 61 an ac power source 62 connected to the pen manipulator with lead wires. With the structure of FIG. 5A, it is possible to detect the position of the coil of the movable manipulator, but it is not possible to detect a pressure corresponding to the bow pressure.

FIG. 5B shows a structural example for detecting the manipulation pressure. A pen point or the like at the manipulated end of the movable manipulator is formed in a movable member biased with a spring and a magnet 67 is coupled thereto. In response to performance manipulation, the magnet 67 moves up and down. This magnet 67 is disposed in the neighborhood of a coil. Namely, when the magnet moves up and down, an induction current is induced in the coil 68 and can be detected by a detection circuit 69.

Namely, when the structures of FIG. 5A and FIG. 5B are combined and incorporated in a movable manipulator as shown in FIG. 5C, the position and the pressure of the performance manipulation can be detected.

It will be apparently to those skilled in the art that various structures can be employed as well as those explained hereinabove.

Figure 5D:
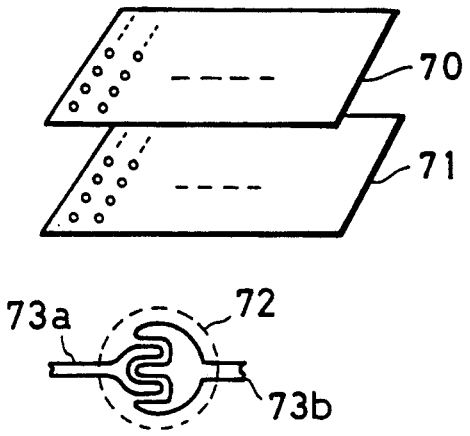

For example, FIG. 5D shows an example of a switch type tablet. A pair of sheets 70 and 71 are superposed wherein part of the switch including two contacts 73a and 73b disposed in the neighborhood is formed on one sheet and the remainder of the switch including a contact 72 having an area overlapping the afore mentioned two contacts is formed on the other sheet. Namely, when a pair of sheets 70 and 71 are superposed and a selected portion is depressed from the above with a finger, etc., the contact 72 connects adjacently disposed contacts 73a and 73b to detect the position. Further, the manipulation pressure can also be detected by disposing a sheet having a conductive rubber, which can serve as a pressure sensitive switch, under the manipulation region.

Figure 5E:
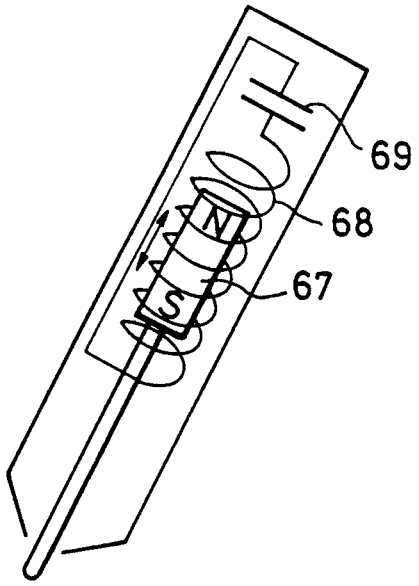

Also, a magnet 67 may be coupled to a pen point of a movable performance manipulator such as a pen manipulator as shown in FIG. 5E. An induction current is induced in a coil 68 by the movement of the magnet 67 and the generated current is once stored in current storing means 69 such as a capacitor. Then, the stored current is allowed to flow through the coil in the opposite direction. A magnetic field generated by this current can be detected by a plane shaped detection means as shown in FIG. 5A. In such a structure, there is no need to provide a power source in the movable manipulator, easily realizing a chordless structure.

If a performance manipulator having a plane shaped manipulation region is used as shown in FIGS. 4A to 4F, the bow speed information can be generated by moving the movable manipulator in the plane, But, it is not inevitably necessary to use two dimensional performance manipulation region.

Figure 6A:
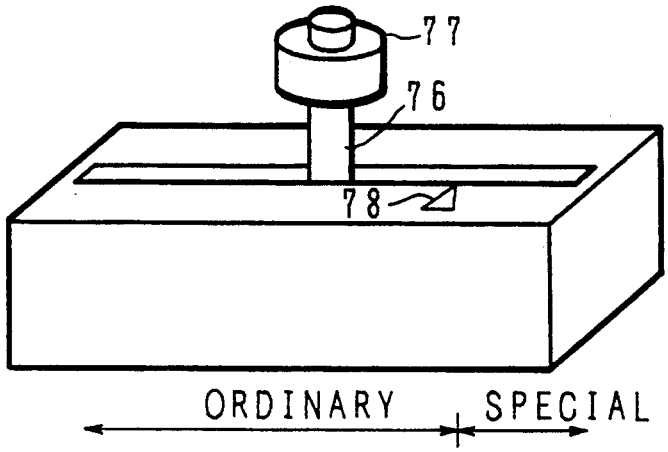
FIGS. 6A and 6B are schematic diagrams for illustrating linear manipulators.
Figure 6B:
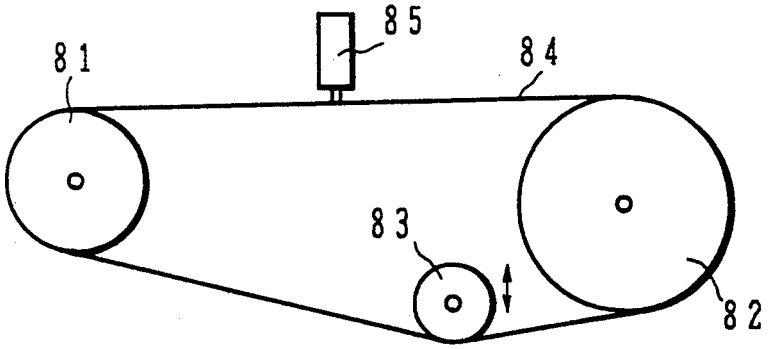

FIGS. 6A and 6B show a performance manipulator of one dimension type.

In FIG. 6A, a sliding terminal 76 of a sliding resister or potentiometer device moves on a resistance element, and a pressure sensitive switch 77 is provided on the sliding terminal. The whole region of the resistance element is divided into ordinary performance region and a special performance region by, for example, a marker 78. In each divided region, the position of the sliding terminal can be detected through the associated resistance value. By detecting the change of the position, a bow speed information can be derived. A bow pressure information can be obtained from the pressure sensitive switch 77. If the bow speed information is not necessary in the special region, only the information of selecting a region and the bow pressure information can be provided.

FIG. 6B shows a structure wherein a belt 84 is circulated around pulleys and a bow speed information is obtained from the moving speed of the belt 84 driven, for example, by a pulley 82. For example, a linear encoder 85 is provided at one position near the belt and detects the translation of the belt to provide the bow speed information. When the pulley 82 can be pushed along the axis to change the tension of the belt, the bow pressure information can be obtained by detecting pressure applied to the belt 84, around a small pulley 83.

As is described above, by utilizing performance manipulators having at least one dimensional manipulation region, the bow speed information required for controlling the tone signal of a rubbed string instrument can be provided. Also, the bow pressure information can be obtained by detecting the pressure of the manipulation, etc.

Next, flow chart for achieving performance of a rubbed string instrument using the structure as explained above will be described.

Figure 7:
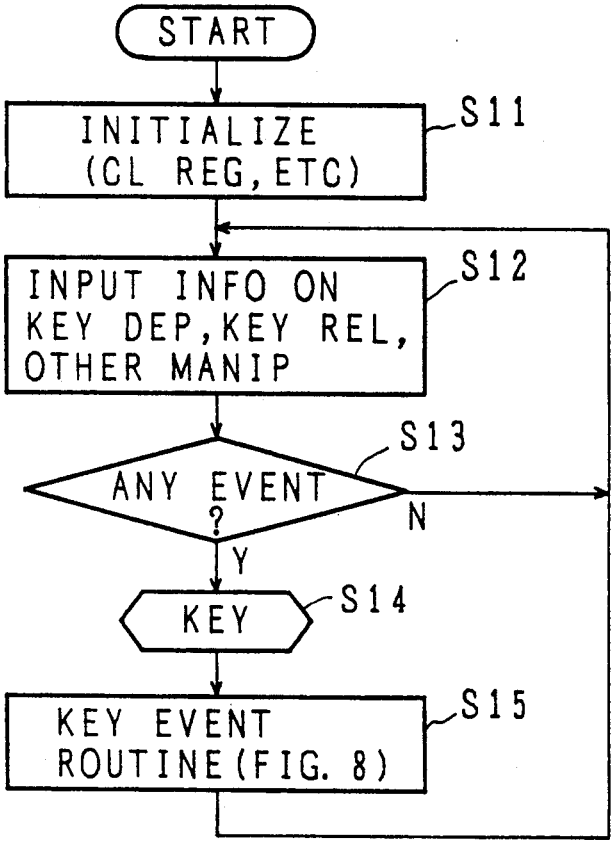
FIG. 7 is a flow chart of the main routine.

First, main routine is shown in FIG. 7. When the main routine is started, initialization is done in step S11. For example, clearing of the respective registers is done. In the next step S12, information of key depression and key release in the keyboard and the information on the manipulation of the respective manipulators such as plane manipulator, etc. are detected and inputted.

When the performance manipulation information is inputted, it is discriminated whether an event or events have occurred or not, in step S13.

If there is an event, the flow goes to step S14. In step S14, it is discriminated whether there is a key event or not. If there is a key event, the flow goes to the key event routine of step S15.

After the key event routine, the flow goes back to step S12. If there is no event in step S13, the flow also goes back to step S12.

Figure 8:
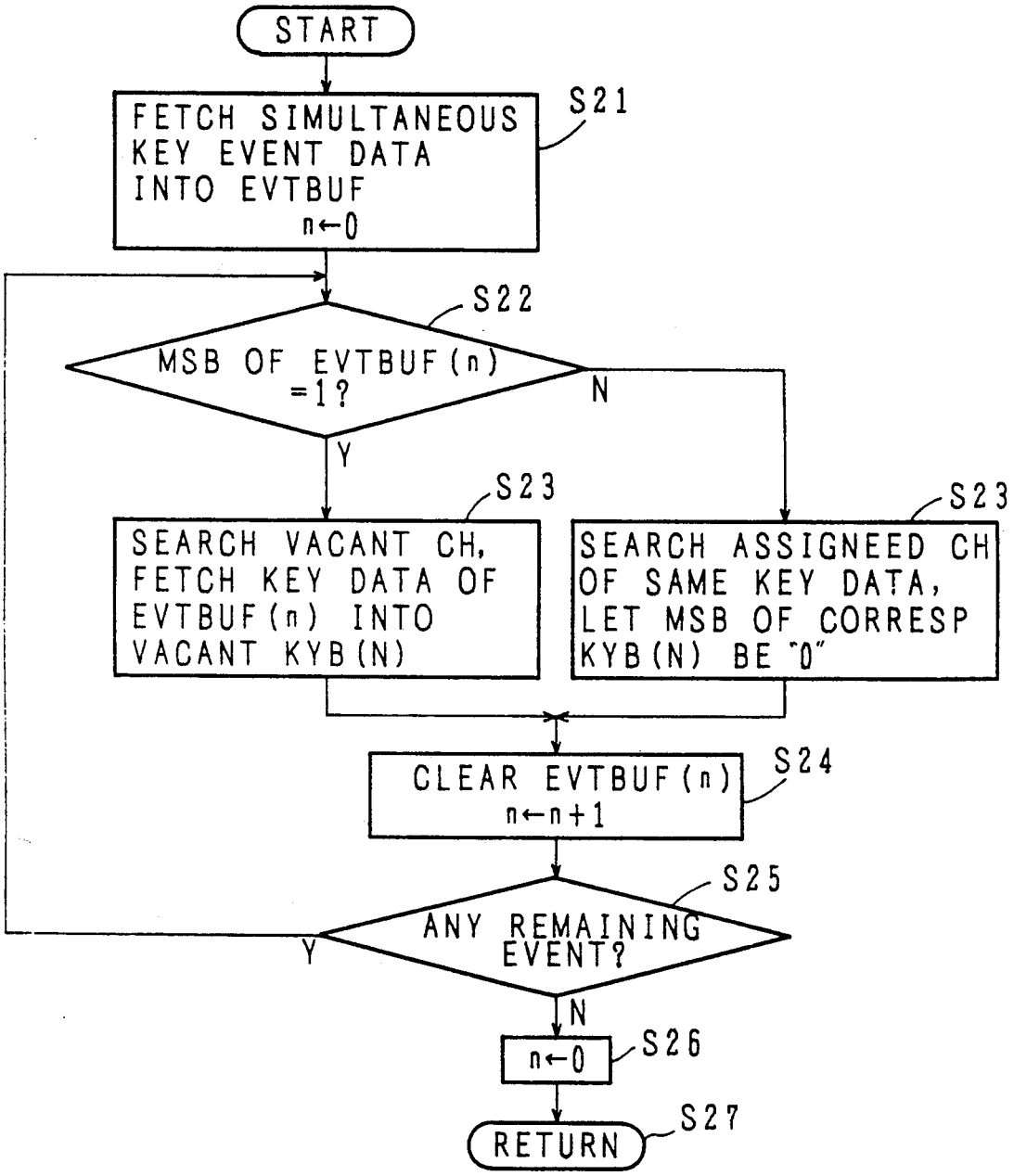
FIG. 8 is a flow chart of the key event routine.

FIG. 8 shows the key event routine. When the key event routine is started, in step S21, data of key events which have occurred simultaneously are fetched into event buffer registers EVTBUF and 0 is set in the numbering resister n.

Next in step S22, it is discriminated whether MSB of the n-th (first 0-th) event buffer register EVTBUF(n) is 1 or not. The fact that MSB is 1 indicates a depressed key state in which a key is depressed. The fact that MSB is 0 indicates a released key state. If MSB is 1, the flow goes to the next step S23 along the arrow Y.

In step S23, vacant channels are searched for inputting the key depression data. The key data of the event buffer register EVTBUF(n) are fetched to a vacant key buffer KYB(n).

In the present embodiment, when there is no vacant channel, channel assignment will not be done. However, the channel assigned most oldly may be searched as described below, and the old data may be rewritten by the key depression data successively.

Then, the event buffer register EVTBUF(n) which has finished data transfer of the key data is cleared. Then the number n is counted up by one, n+1 (step S24).

In the next step S25, it is checked whether there are remaining event data in the event buffer register or not. If there is no remaining data, 0 is set in the number n to terminate the processing (step S26), and the flow returns (step S27).

When there is any remaining event in the event buffer register, the flow goes back from the step S25 to step S22.

In step S22, if MSB of the n-th event buffer register EVTBUF(n) is 0, the flow goes to step S28 and a channel assigned with the same key data is searched for. Namely, MSB=0 means key release and for realizing key release a key depression should exist beforehand. Therefore, a key buffer which stores the depressed key data is searched for. When the channel assigned to the depressed key data is searched, the associated key buffer KYB(N) corresponding to the key release is cleared and the corresponding musical sound is terminated.

In the present embodiment, for generating a musical sound, it is necessary that any one key in the keyboard is depressed and the movable manipulator touches the manipulation plane in the plane manipulator. In an electronic musical instrument which requires two conditions of key depression and manipulation of the movable manipulator as the condition for generating a sound, the musical sound will be erased when the key is released. Here, in case when an assignment system is employed in which the most oldly assigned key data is successively rewritten as will be described latter, processing corresponding to the key release event may be dispensed with and manipulation of a pen manipulator may be employed as the sole condition for generating musical sound.

Next timer interrupt routine will be described referring to FIG. 9. First, when the timer interrupt has occurred, it is checked in step S31 whether the pressure data PB stored in a pressure buffer is greater than a predermined pressure P1 and there is data in any of key buffers KYB. Namely, when pressure is applied to the plane manipulator and any key in the keyboard is depressed, a musical sound will be generated. Here, the condition whether there is data in any of key buffers KYB may be removed. In other words, it is arranged that no musical sound will be generated only by key depression nor by manipulation on the plane manipulator, thereby preventing sound generation by erroneous action.

When the both conditions are satisfied, in the next step S32, coordinates xp and yp and pressure P0 which are the outputs of the plane manipulator 1 are fetched to the respective registers X, Y and P. Then in step S33, it is discriminated whether the manipulation position in the plane manipulator is located in the special area or not based on position data X and Y. If the position is in the special area, the flow goes to step S40 and one of the sub-routines 1 to 4, which will be described later, is done.

If the position is not in the special area, i.e. in the ordinary area, the flow goes to step S34 and it is checked whether flag OLD is "0" or not. If the event is new, the flag is still "0" and the flow goes to step S39 to set "1" in flag OLD.

If the flag is already set, the flow goes to step S35 and the distance between the coordinates (xn, yn) at the previous timer interrupt and the coordinates (X, Y) at the current timer interrupt is measured. Timer interrupt occurs at a constant time interval. The length between the previous measurement and the current measurement is proportional to the speed. Therefore, this information is stored in register V as a velocity information.

Next, the velocity data in register V and pen pressure data in the pressure register P are stored in the velocity buffer VB and the pressure buffer PB, which are the latch means provided in the tone signal generating circuit (step S36). Here, the pen pressure data is converted by utilizing a table representing a desired input-output characteristic. The value after the conversion is stored as the pressure data.

After the velocity data is obtained, the old position data xn and yn are replaced with new data X and Y (step S37). Namely, the new data becomes the old data in the next processing. Then the flow returns (step S38).

In step S31 if at least one of the two conditions is not satisfied, the flow goes to step S41 to clear velocity buffer VB, pressure buffer PB and flag OLD.

In this way, musical sounds of a rubbed string instrument are generated when the plane manipulator is manipulated together with depression of a key in the keyboard according to this program.

Next, the above-mentioned sub-routines 1 to 4 will be described referring to FIGS. 10 to 13.

Figure 10:
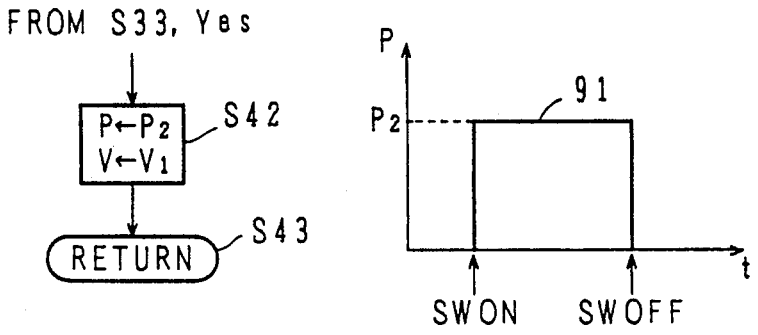
FIG. 10 is a flow chart illustrating the sub-routine 1 in the timer interrupt routine.

FIG. 10 shows sub-routine 1. When the position is discriminated as in the special area in step S33, a certain pressure data P2 and a certain velocity data V1 are set as the pressure P and the velocity V in step S42. Namely, as shown in the righthand side graph, such a characteristic 91 is set in which a constant pressure P2 is set when the switch is turned on and continues till the switch is turned off. After such a parameter is set, the flow returns (step S43). Here, similar variation is set for the velocity as the pressure.

Figure 11:
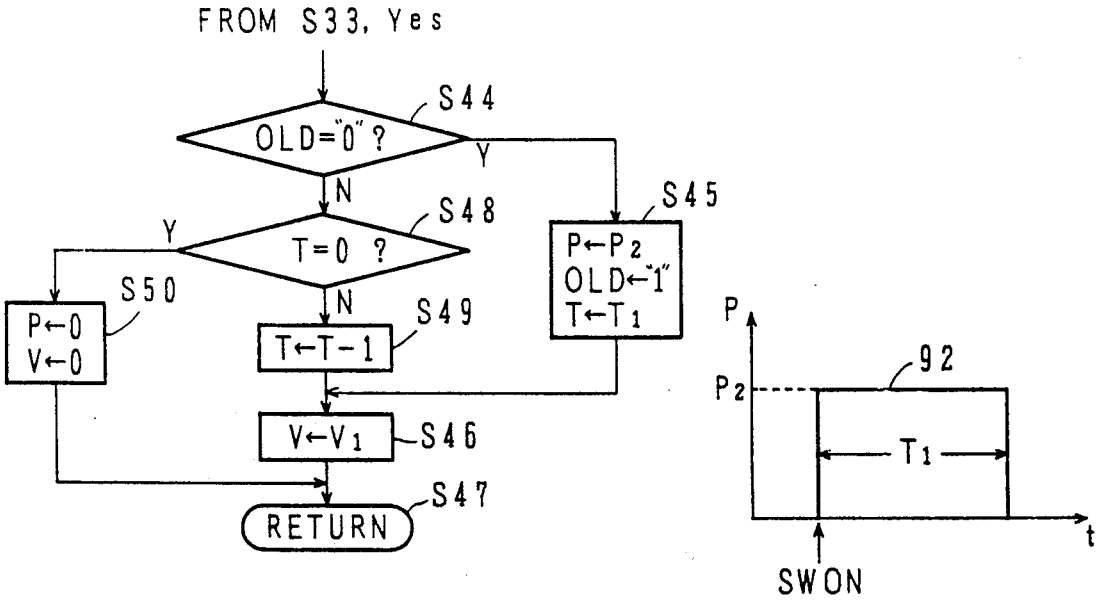
FIG. 11 is a flow chart illustrating the sub-routine 2 in the timer interrupt routine.

FIG. 11 shows sub-routine 2. When the position is discriminated to lie in the special area in step S33, it is discriminated whether flag OLD is "0" or not in step S44.

If the flag is "0", it means a new phenomenon. Then, the flow goes to step S45, a constant pressure P2 is set as the pressure P, flag OLD is set to "1", and a predetermined time T1 is set as the time T. Namely, as shown in the graph on the righthand side, such a characteristic 92 is set in which pressure P2 is set when the switch is turned on and sustains for a predetermined time period T1.

Since flag OLD becomes "1" at the next timer interrupt, the flow proceeds to step S48 and it is discriminated whether time T is "0" or not. If a predetermined time has not elapsed after the switch-on, time T is not yet "0" and the flow goes to step S49 to reduce time T by one.

Next, a predetermined value V1 is set as parameter V as the velocity data (step S46). Then, the flow returns (step S47). When time T is reduced to "0", the flow goes from step S48 to step S50 along the arrow Y to set pressure P to "0" and velocity V to "0". The flow then returns (step S47).

Figure 12:
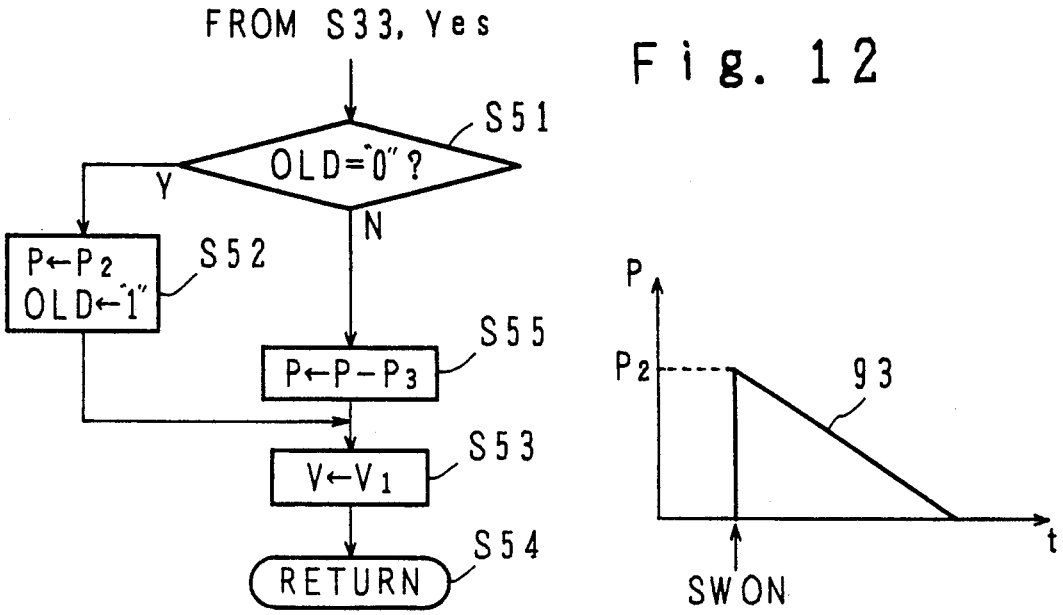
FIG. 12 is a flow chart illustrating the sub-routine 3 in the timer interrupt routine.

FIG. 12 shows sub-routine 3. When the position is discriminated as in the special area in step S33, the flow goes to step S51 to discriminate whether flag OLD is "0" or not. In step S51, if flag OLD is "0", a constant P2 is set as initial value of pressure P and flag OLD is set to "1" in step S52.

When it is not a new phenomenon, flag OLD is "1", then the flow goes to step S55. In step S55, pressure parameter P is decreased by a certain amount P3. Namely, pressure P is gradually decreased.

Next, in step S53, a predetermined value V1 is set as velocity V. Thereafter, the flow returns (step S54).

Namely, according to the sub-routine 3, as shown in the graph on the righthand side, there is provided a characteristic 93 in which the pressure P abruptly increases to a predetermined value P2 upon the switch-on and linearly decreases to 0.

Figure 13:
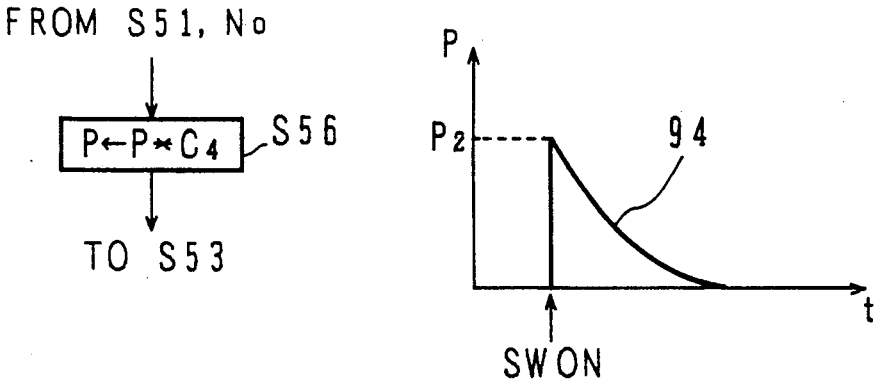
FIG. 13 is a flow chart illustrating the sub-routine 4 in the timer interrupt routine.

FIG. 13 shows sub-routine 4. Comparing with the flow chart of FIG. 12, the step S55 is replaced with step S56. When flag OLD is "1" in step S51. Namely, instead of decreasing the pressure by reducing the current value P by a constant value P3, a constant factor C4 ($<1$) is multiplied to the current value P to gradually decrease the pressure. Namely, the pressure P decreases at a constant rate from the initial value P2 upon the lapse of a constant time, to provide an exponential decrease as shown by characteristic 94.

The above-mentioned sub-routines 1 to 4 can be selected depending on various performance mode of various musical instruments. Further, combinations of these modes, partial alterations, etc. can be done to further modify the characteristics.

In the above-mentioned embodiments, the existence of a pressure on the plane manipulator and depression of a key in a keyboard constitute conditions for generating a musical sound. However, in case of playing on a keyboard, when the tone pitch jumps widely, it is inevitable that the key depressing finger instantly departs from the key in the performance. In the performance of a rubbed string instrument, however, tones having widely separated tone pitches may be continuously played by rubbing adjacent strings. Alternative embodiments will be described referring to FIGS. 14A and 14B which can respond to such situation.

Figure 14A:
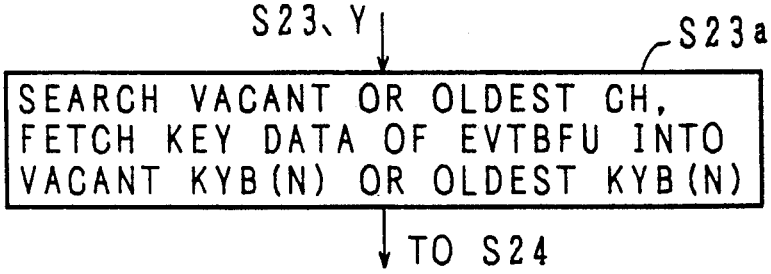
FIG. 14A to 14C are flow charts illustrating alternative embodiments of the timer interrupt routine.

FIG. 14A shows an alternative embodiment of a key event routine which is to be done in the key event routine described in connection with FIG. 8 when the number of key events is large and there is no vacant channel. Namely, step S23*a* is used in place of step S23. A vacant channel is searched for and if there is a vacant key buffer KYB(N), the key data is fetch therein. When there is no vacant key buffer, the oldest channel is searched for and the key data in key event buffer EVTBUF is fetched into that key buffer KYB(N).

Figure 14B:
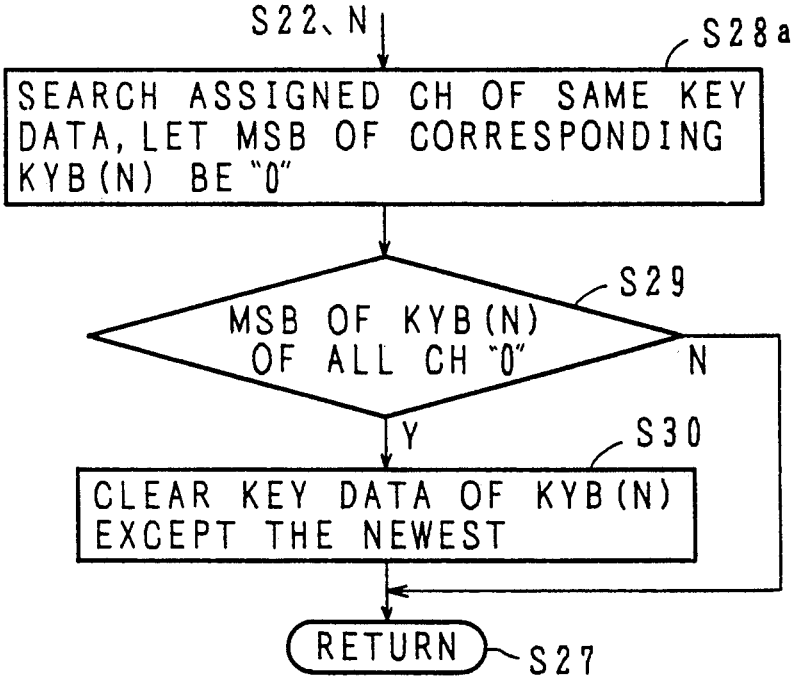

When, in step S22 of FIG. 8, MSB is 0, processing of step S28*a* and on shown in FIG. 14B may be done in place of step S28 on. Namely, when MSB is 0 and a key in the keyboard in released, the channel assigned with the same key data is searched and MSB of the corresponding key buffer KYB(N) is set to 0. By this step, the key release is registered.

Next, in step S29, it is checked whether MSBs of key buffers KYB(N) of all the channels are 0 or not.

If MSBs of all the channels are 0, in the next step S30, key data except those of the key buffer KYB(N) of the newest channel are cleared. Namely, information of the newest key buffer KYB(N) remains. By this action, the musical sound continues to be generated according to the newest key release information. Namely, when separated position in the keyboard is to be played continuously, and even if the finger inevitably departs from the keyboard, the musical sound of the rubbed string instrument is continuously generated.

In step S29, if any MSB of the key buffer KYB(N) is not 0 and is 1, step S30 is skipped over and the flow returns (step S27).

Figure 9:
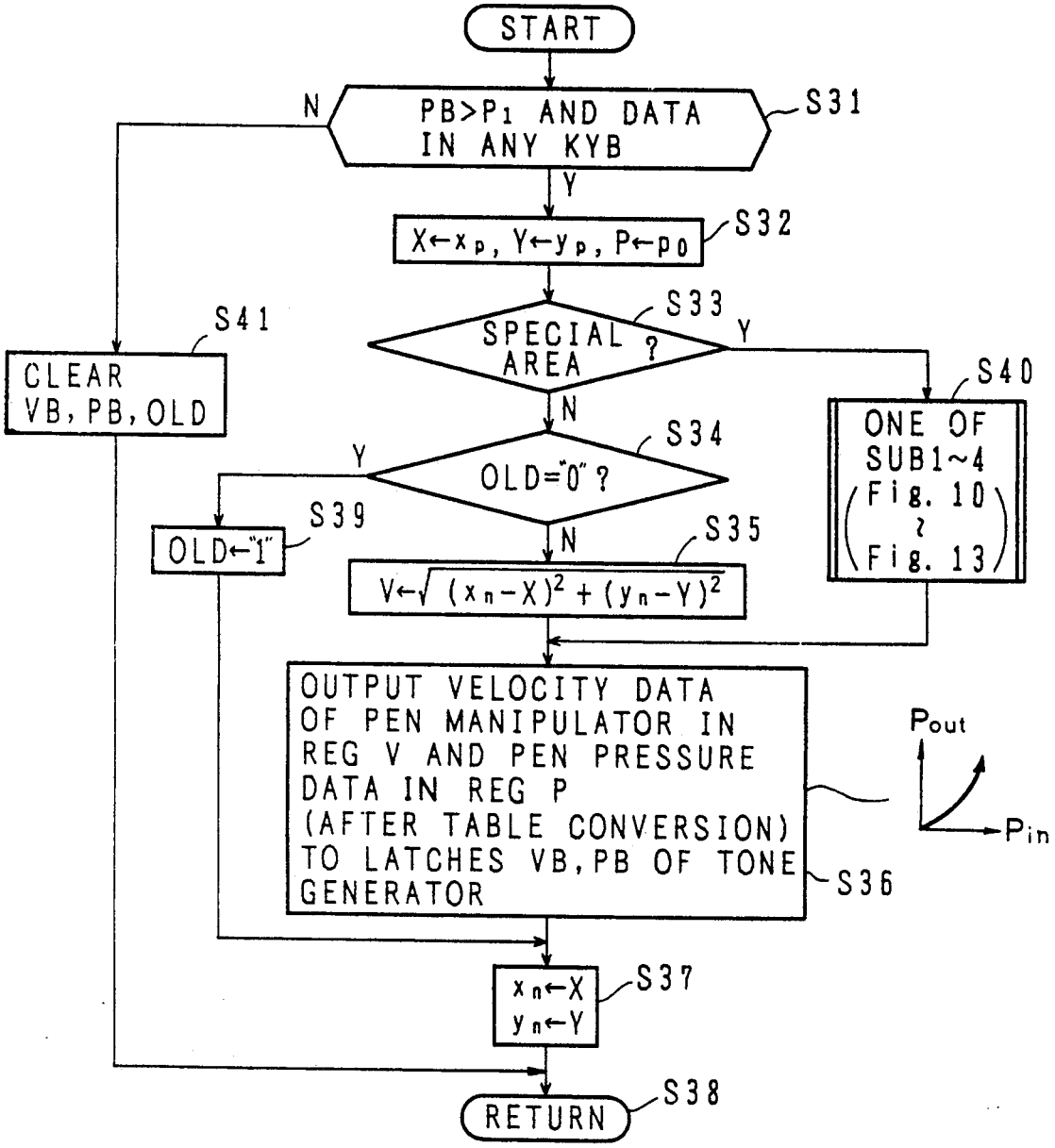
FIG. 9 is a flow chart of the timer interrupt routine.
Figure 14C:
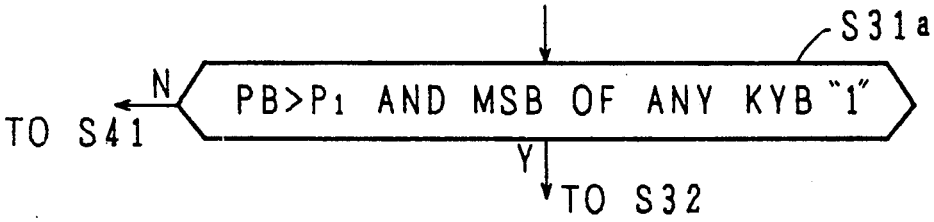

In the timer interrupt flow chart of FIG. 9, it was checked whether data is stored in any of the key buffers KYB. In this embodiment, in place of step S31, step S31*a* is to be achieved as shown in FIG. 14C. It is checked whether the pressure is larger than a predetermined value P1 and the MSB of any key buffer KYB is "1" or not. Namely, instead of checking the existence of the key data itself, MSB is checked to detect the key-on.

If MSB="1", the data is stored in a key buffer register (step S23 of FIG. 8). Then, the flow goes to step S32 of FIG. 9 and then data of the coordinates and the pressure are fetched.

Description has been mainly made on the performance of a rubbed string instrument taking an example in the violin, but guitar sounds may also be generated using a similar electronic musical instrument.

A timer interrupt flow chart for guitar will be described, referring to FIG. 15.

Figure 15:
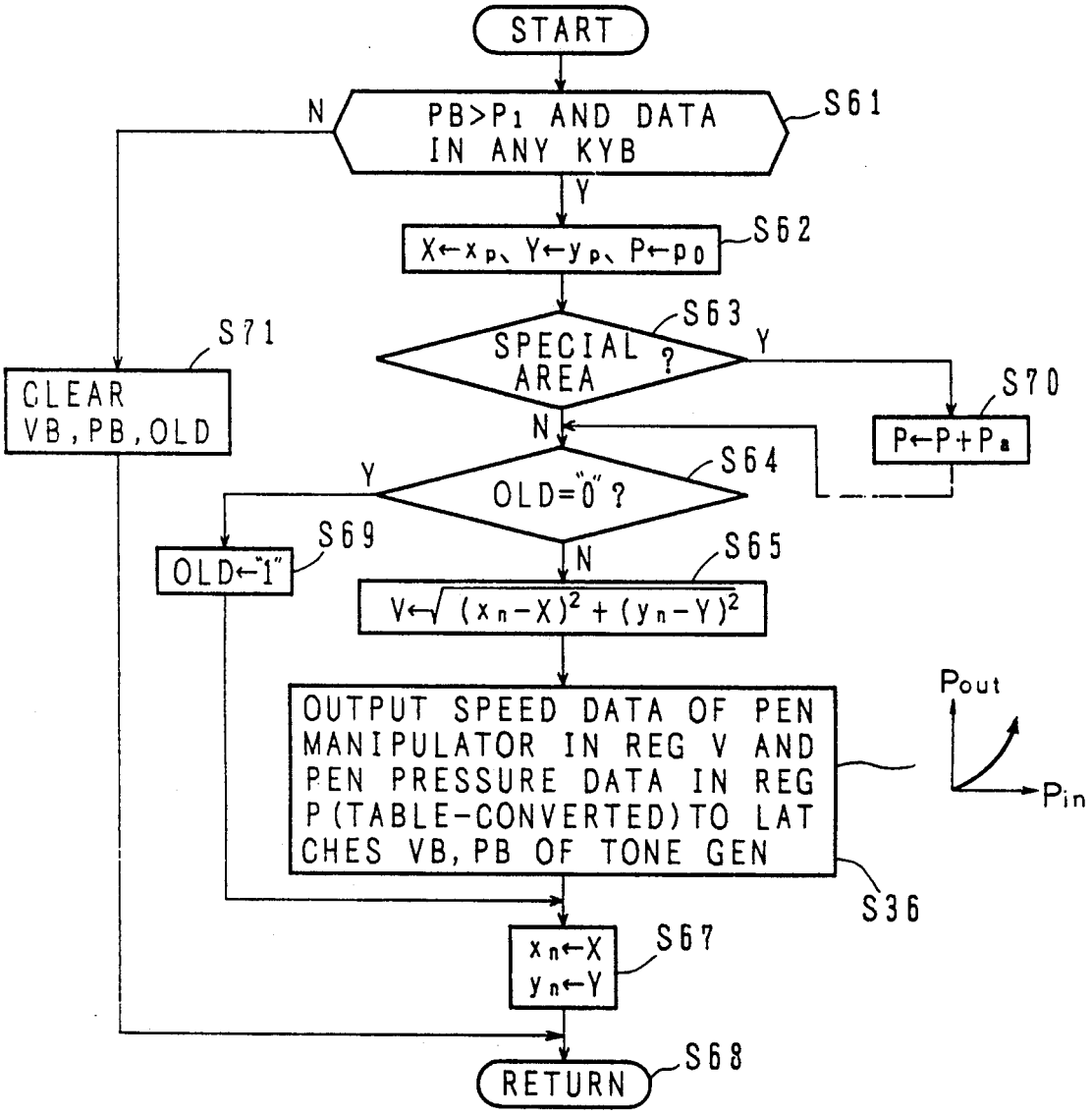
FIG. 15 is a flow chart illustrating an alternative embodiment of the timer interrupt routine adapted for the guitar.

In the flow chart of FIG. 15, when the processing is started, it is checked whether there is a pressure greater than a predetermined value PB>P1, and whether there is data in any of the key buffers KYB or not in step S61. In this logic, tone generation requires two conditions to ensure that even one of the keyboard and the performance manipulator is touched by an erroneous action, no sound is generated. When the both conditions are satisfied, it is indicated that the guitar is being performed. Then the flow goes to step S62 to fetch the position xp and yp of the pen manipulator to the respective registers X and Y. Further, a constant pressure P0 is set as the parameter P.

Then the flow shifts to step S63 where it is discriminated whether the position represented by X and Y is located in the special area or not. If it is not in the special area, ordinary performance is indicated and flow goes to step S64 to achieve processing of al aire performance. In step S64, it is discriminated whether flag OLD is "0" or not. If flag OLD is "0", a new phenomenon is indicated and flag OLD is set to "1" in step S69. If flag OLD is not "0". it is the second or later detection. Then in step S65, a transition distance is obtained from the previously detected position and the currently detected position to store it in the velocity register V. The transition distance in a unit time length forms a parameter representing the velocity.

Then, the flow goes to step S66 where the pen manipulation velocity data in register V and the pen pressure data in register P are used to store data in latch means VB and PB of the tone signal generating circuit 8. Here, with respect to the pressure, conversion is done by a conversion table of input vs output having a predetermined characteristic. Then, regardless of the value of flag OLD, "0" or "1", the values of registers X and Y representing the current position are stored in registers xn and yn representing the previous position (step S67). Then, the flow returns (step S68).

If the position is located in the special area in step S63, apoyando performance is detected and the flow goes to step S70. In step S70, a constant value Pa is added to the pressure P to form a new pressure data P. By this action, the pressure P is increased to generate an amplified sound. Thus, apoyando performance generating strong tones is simulated.

If the two conditions are not simultaneously satisfied in step S61, the flow goes to step S71 and registers VB, PB and OLD are cleared to prepare for the next phenomenon.

Figure 16:
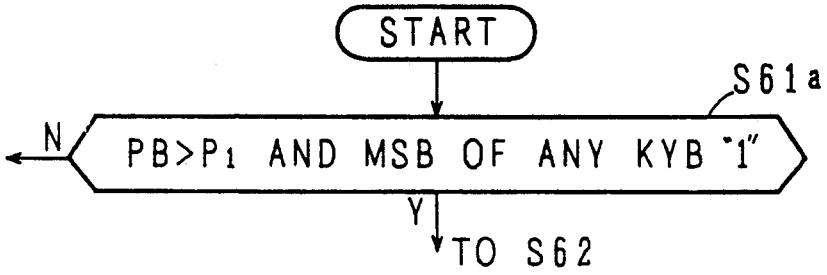
FIG. 16 is a flow chart illustrating an alternative embodiment of the flow chart of FIG. 15.

FIG. 16 shows a modified embodiment. In the embodiment of FIG. 15, the existence of a pressure and the existence of data in any key buffer were checked in step S61. In this modified embodiment, in place of the existence of data itself, it is checked whether MSB of the key buffer KYB is 1 or not. Namely, this modified embodiment can be achieved by replacing step S61 of FIG. 15 with step S61*a* of FIG. 16.

Figure 17:
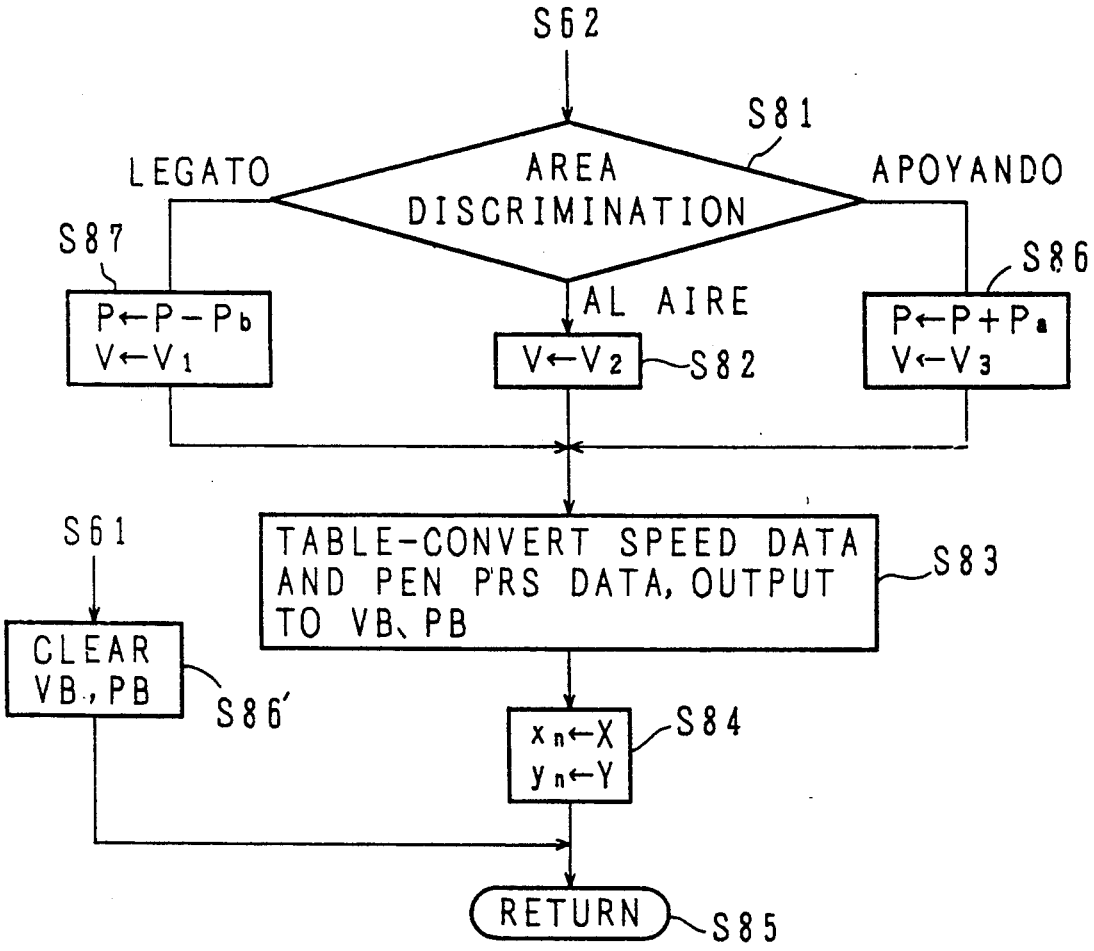
FIG. 17 is a flow chart illustrating an alternative embodiment of the timer interrupt routine of FIG. 15.

FIG. 17 shows a further embodiment. In the embodiment of FIG. 15, information on the position and on the pressure is fetched in step S62 and discrimination of whether it is a special area or not is done in the next step S63.

In this embodiment, it is assumed that the performance manipulator has three selection regions, i.e. al aire 59*a*, apoyando 59*b* and legato 59*c* for the performance of guitar as shown in FIG. 4F. In step S81 following step S62 of data fetching, area discrimination is done to judge which area is designated. In case where there are three designation areas, legato, al aire and apoyando as described above, the following processings are done depending on the designated area.

When al aire corresponding to the ordinary performance is designated, the flow goes to step S82 where a constant value V2 is inputted to the velocity register V. As the pressure, the manipulated pressure P is directly used.

When legato is designated, the pressure P is decreased by a constant amount Pb and is used as the pressure data in step S87. As the velocity data, a constant value V1 is inputted.

When apoyando is designated, the flow goes to step S86. As the pressure P, the inputted pressure is increased by a constant amount Pa, and a constant value V3 is used as the velocity V.

Following steps S82, S87 and S86, step S83 is done. Namely, those values which are obtained by table conversion of the velocity data and pen pressure data are outputted to registers VB adn PB. Next, the current coordinates X and Y are inputted to the coordinates xn and yn for the previous measurement to renew the coordinates in step S84. Then, the flow returns (step S85).

Also, when the both conditions are not satisfied simultaneously in step S61 shown in FIG. 15, registers VB and PB are cleared (step S86').

Figure 18:
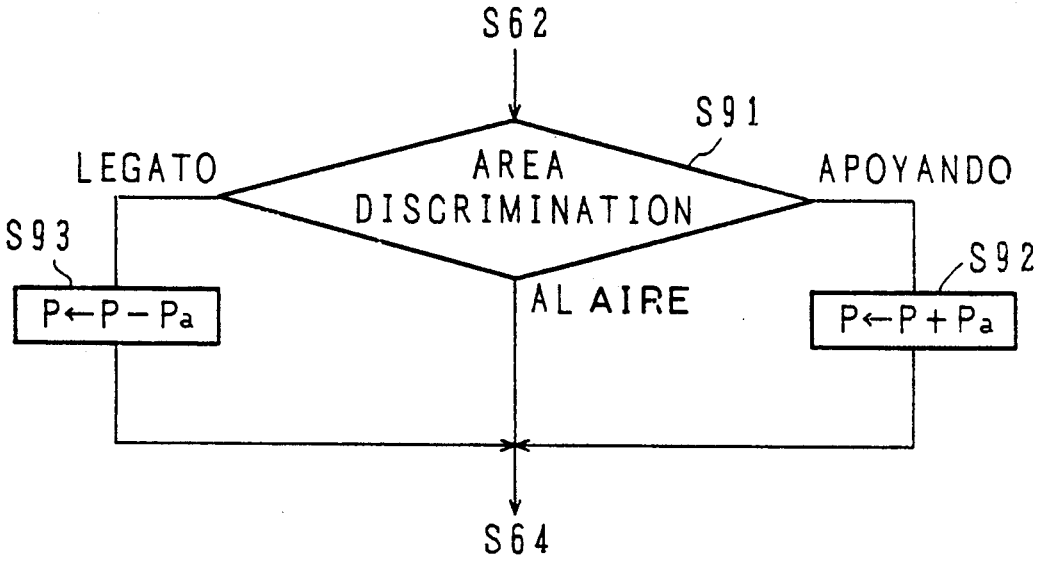
FIG. 18 is a flow chart illustrating another alternative embodiment of the timer interrupt routine of FIG. 15.

FIG. 18 shows another embodiment. After the position and the pressure are fetched in step S62 in the embodiment of FIG. 15, discrimination of the area is done in step S91. Similar to the embodiment of FIG. 17, it is assumed that there are three areas, legato, al aire and apoyando.

When legato is designated, for generating weak sounds corresponding to legato, a constant value Pa is subtracted from the pressure P to form a weak pressure to be used as the input pressure.

When al aire is designated, since it is the ordinary performance, the inputted pressure data P is directly used.

When apoyando is designated, for generating strong sounds, a constant value Pa is added to the pressure data P and the increased pressure P is used as the pressure (step S92).

Following these steps, step S64 of FIG. 15 is done.

In this way, various performances of the string instrument can be selected to generate the corresponding musical sound.

Particularly, in the case of the rubbed string instrument, bow pressure information is generated based on the pressure with which the pen manipulator is depressed, while bow speed information is generated based on the moving speed in the plane manipulator, to provide information of the bow speed and the bow pressure necessary for generating musical sounds of the rubbed string instrument.

Also, when the musical sounds of string instruments such as guitar are simulated, the pressure data are varied depending on the performance mode, legato, al aire or apoyando, to generate the corresponding musical sound.

Although description has been made on several manipulators which have two dimensional or one dimensional manipulation regions, the present invention is not limited thereto. For example, it is also possible to use such manipulators as one which can divide the manipulation region arbitrarily by carsor or keyboard, etc., one which use a light pen and a light sensitive display surface, one which display a manipulation region with color, and one which input the data in three dimensions utilizing the polar coordinates, etc. Also, the present invention can be applied to the long tone performance and the tonguing performance of a wind instrument, as well as a rubbed string instrument. In such a case, continous manipulation information may be given to the long tone performance, similar to arco performance. Pulse like information may be given to tonguing performance, similar to pizzicato performance.

Also, waveform memory tone generator, fm tone generator, etc. can be utilized as the tone generator as well as the physics model tone generator as described above.

Sole use circuits for achieving the steps of the program may be used in place of the combination of CPU, ROM and RAM.

As is described above, according to the embodiments of this invention, there is provided manipulation means having at least one dimensional manipulation regions in which performance mode can be designated by the region to be manipulated. Thus, the musical sounds of an instrument which can be performed in various ways can be appropriately simulated.

Further, velocity information can be given by moving a movable manipulator in a manipulation region and taking the transition velocity.

By such velocity information, for example, information of the bow speed representing the movement of the bow relative to the string in a rubbed string instrument or embouchure information in the performance of a wind instrument can be given.

Further, pressure information can be given by detecting the pressure which the movable manipulator gives.

For example, the bow pressure with which a bow of a rubbed string instrument is depressed to a string or a breath pressure in a wind instrument can be simulated by this pressure information.

Although description has been made on the selected embodiment of this invention, the present invention is not limited thereto. For example, it will be apparent that various alteration, modifications, improvements, combination thereof are possible.

We claim:

1. An electronic musical instrument comprising:

performance receiving means for receiving performance manipulation, having a manipulation region of at least one dimension, said manipulation region having at least two zones, each zone containing a plurality of positions in which performance manipulation may be achieved;

position detecting means for detecting a position of performance manipulation in said manipulation region and generating a position signal;

selecting means for discriminating between a first zone of said manipulation region and a second such zone based on said position signal, and selecting a performance mode based on the zone so discriminated;

controlling means for generating a tone controlling signal based on the performance mode selected by said selecting means; and tone signal generation means for generating a tone signal based on said tone controlling signal.

2. An electronic musical instrument as defined in claim 1, further comprising:

pressure detecting means for detecting a pressure of said performance manipulation in said manipulation region and generating a pressure signal; and supplying means for supplying said pressure signal to said controlling means, wherein said tone controlling signal is further based on said pressure signal.

3. An electronic musical instrument as defined in claim 1, further comprising a manipulator for achieving said performance manipulation on said manipulation region, said manipulator transmitting a signal to said performance receiving means to indicate the position of performance manipulation.

4. An electronic musical instrument as defined in claim 2, further comprising a manipulator for achieving said performance manipulation on said manipulation region, said manipulator containing said pressure detecting means.

5. An electronic musical instrument as defined in claim 1, wherein manipulation in a first zone designates an ordinary performance and manipulation in a second zone designates a special performance, and wherein said first zone is larger than said second zone.

6. An electronic musical instrument as defined in claim 1, wherein said performance receiving means comprises a plane manipulation region and a pen shaped movable manipulator, and said position detecting means detects a coordinate on said plane manipulation region, said coordinate being designated by said pen shaped movable manipulator.

7. An electronic musical instrument as defined in claim 1, wherein said tone signal generation means includes closed-loop means for circulating a signal input thereto, said closed-loop means having at least one delay unit, excitation means for generating an excitation signal which is input to said closed-loop means and non-linear conversion means for converting at least the tone controlling signal according to a non-linear function to provide the excitation signal.

8. An electronic musical instrument as defined in claim 1, further comprising speed detection means for detecting a speed of said performance manipulation based on a time variation of said position signal and generating a speed signal, and wherein said tone controlling signal is further based on said speed signal.

9. An electronic musical instrument as defined in claim 8, wherein said controlling means generates a first tone controlling signal based on said speed signal when said selection means has selected a first performance mode and generates a second tone controlling signal based on a predetermined input signal when said selection means has selected a second performance mode.

* * * * *

UNITED STATES PATENT AND TRADEMARK OFFICE

CERTIFICATE OF CORRECTION

PATENT NO. : 5,247,131

DATED : September 21, 1993

INVENTOR(S) : Tetsuo Okamoto, Eiichiro Aoki, Satoshi Usa

It is certified that error appears in the above-identified patent and that said Letters Patent is hereby corrected as shown below:

On title page, insert item

--[30] Foreign Application Priority Data
Dec. 14, 1989 [JP] Japan.....1-324627-- .

Signed and Sealed this

Sixteenth Day of August, 1994

Bruce Lehman

*Attest:*

BRUCE LEHMAN

*Attesting Officer*

*Commissioner of Patents and Trademarks*